United States Patent [19]

Miller

[11] Patent Number: 5,027,511

[45] Date of Patent: Jul. 2, 1991

[54] SHAVING SYSTEM

[75] Inventor: Gary R. Miller, Tewksbury, Mass.

[73] Assignee: The Gillette Company, Boston, Mass.

[21] Appl. No.: 589,997

[22] Filed: Sep. 28, 1990

[51] Int. Cl.[5] ..... B26B 21/52

[52] U.S. Cl. ..... 30/85; 16/110 R; 16/DIG. 12

[58] Field of Search ..... 30/85, 86, 87, 88, 89; 16/110 R, 116 R, 114 R, DIG. 12, DIG. 15, DIG. 18, DIG. 19, DIG. 24; D28/46, 48

[56] References Cited

U.S. PATENT DOCUMENTS

| | | | |
|---|---|---|---|
| Re. 32,747 | 9/1988 | Ullmann | 16/110 R |
| D. 257,793 | 1/1981 | Gray | D28/48 |
| D. 261,565 | 10/1981 | Grange | D28/48 |
| D. 271,625 | 11/1983 | Gray | D28/48 |
| D. 295,900 | 5/1988 | Bonori | D28/46 |
| 2,666,257 | 1/1954 | Butlin | 30/62 |
| 2,742,693 | 4/1956 | Nigro | 30/40 |
| 3,189,069 | 6/1965 | Stowell | 16/116 R |
| 3,216,052 | 11/1965 | Hill | 16/116 R |
| 3,878,605 | 4/1975 | Braginetz | 30/85 |
| 4,587,729 | 5/1986 | Jacobson | 30/41 |
| 4,949,457 | 8/1990 | Burout | 30/85 |

OTHER PUBLICATIONS

Gillette Sensor, *Patented Easy Loading System,* 1989.

*Primary Examiner*—Douglas D. Watts
*Assistant Examiner*—Rinaldi Rada
*Attorney, Agent, or Firm*—Fish & Richardson

[57] ABSTRACT

A composite handle structure for a shaving system of the wet shave type includes housing structure with an array of spaced apertures extending between inner and outer faces of the housing structure, and compressible resilient insert structure having a durometer value of about 50 Shore A. The insert structure has a body portion and an array of projection portions integral with the body portion. The outer face of the body portion is seated against the inner face of the housing structure and the projection portions extend through the apertures in the housing structure to provide an array of soft, tactile, spaced portions that project above the outer face of the housing structure, the composite handle providing comfortable, secure and user-friendly gripping structure for the razor user.

10 Claims, 1 Drawing Sheet

SHAVING SYSTEM

This invention relates to wet shaving, and more particularly to handle structures for shaving systems of the wet shave type.

The handle portion of a wet shave type shaving system is frequently textured in some manner to provide a gripping surface for the user, such texturing being particularly desirable because of slipperiness imparted to the handle resulting from contact of the handle with soap and water during shaving.

In accordance with the invention, there is provided a composite handle structure for a shaving system of the wet shave type that includes a housing structure with an array of spaced apertures extending between inner and outer faces of the housing structure, and compressible resilient insert structure having a durometer value of about 50 Shore A. The insert structure has a body portion and an array of projection portions integral with the body portion. The outer face of the body portion is seated against the inner face of the housing structure and the projection portion extend through the apertures in the housing structure to provide an array of soft, tactile, spaced portions that project above the outer face of the housing structure, the composite handle providing comfortable, secure and user-friendly gripping structure for the razor user.

In preferred embodiments, the housing structure is metal and of elongated cylindrical configuration, and the insert member is of elastomeric material.

In a particular embodiment, the housing is cylindrical and each projection portion is of elongated rib configuration and has an angular length of at least 90° about the cylindrical housing. The ribs are disposed transversely to the longitudinal axis of the grip portion, are arranged in series at a density of about three ribs per centimeter length of the grip, and are spaced at least one millimeter apart. Each rib in that embodiment has a width of at least about two millimeters and a length of at least about six millimeters and projects at least about 0.5 millimeter beyond the outer face of the cylindrical housing.

Other features and advantages of the invention will be seen as the following description of a particular embodiment progresses, in conjunction with the drawings, in which.

DESCRIPTION OF PARTICULAR EMBODIMENT

Figure 3:
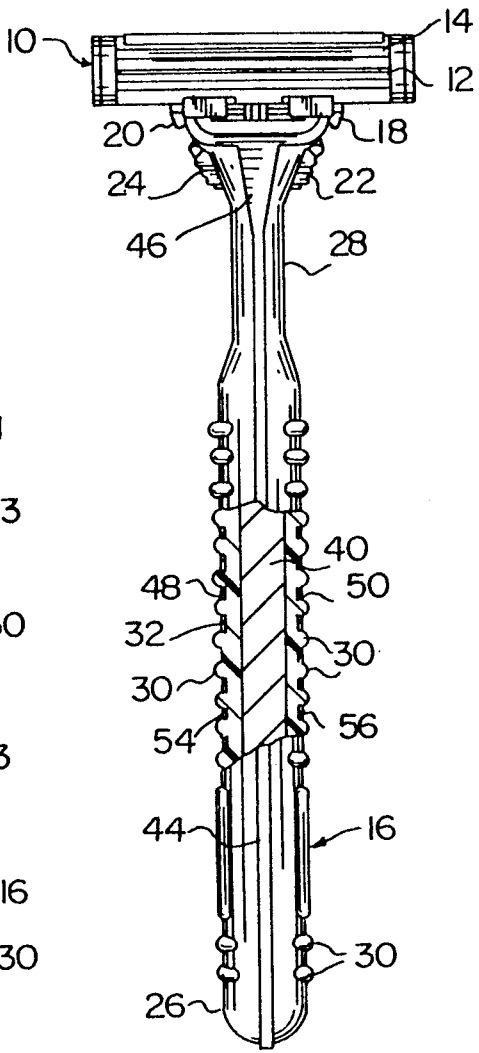
FIG. 3 is a front elevational view of the shaving system shown in FIG. 1 with parts broken away along the line 3—3 of FIG. 2.
Figure 2:
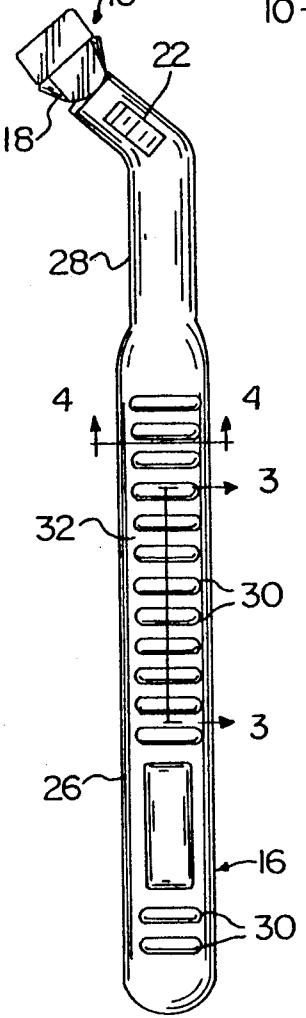
FIG. 2 is a side elevational view of the shaving system shown in FIG. 1.
Figure 1:
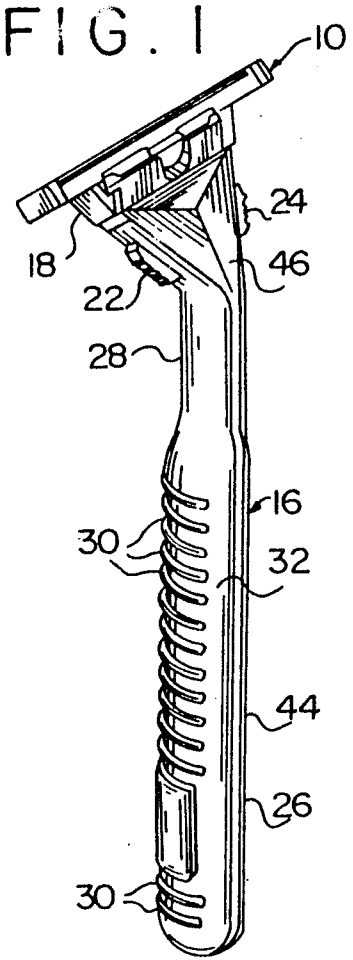
FIG. 1 is a perspective view of a shaving system in accordance with the invention.

The shaving system shown in FIGS. 1–3 is of the type shown in Jacobson U.S. Pat. No. 4,587,729 (the disclosure of which is expressly incorporated herein by reference) and includes cartridge 10 that carries two spaced blade members 12, 14 and is connected to handle structure 16 by depending extensions 18, 20 that have inwardly extending arcuate rail surfaces. Shell bearing portions of the razor handle 16 are actuated by opposed members 22, 24 to engage the rail surfaces of extensions 18, 20.

Handle 16 has a cylindrical body portion 26 that is about eight centimeters in length and has a diameter of about one centimeter and an extension portion 28 that has a diameter of about 0.8 centimeter and a length of about two centimeters. Projecting from the outer face of body portion 26 on opposite sides thereof are a series of ribs 30 spaced about 1.7 millimeters apart. Each rib 30 has a length of about eight millimeters, a width of about two millimeters and a height above the outer surface 32 of about 0.7 millimeter.

Figure 4:
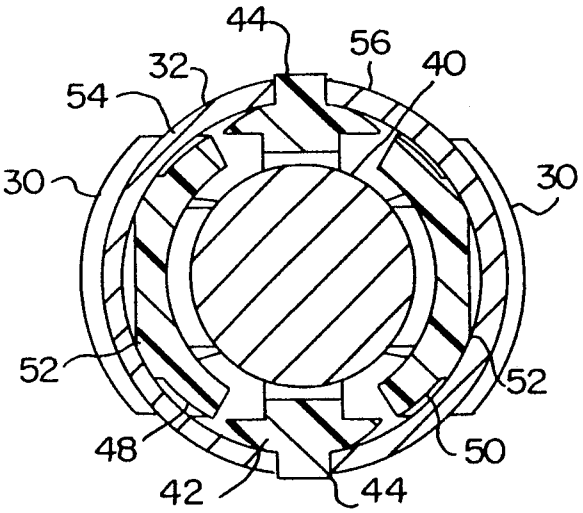
FIG. 4 is a sectional view taken along the line 4—4 of FIG. 2.

As indicated in FIGS. 3 and 4, the grip assembly 26 includes cylindrical elongated brass member 40 that has a diameter of about three millimeters; insert 42 of ABS plastic that has an inner dimension of about 3.2 millimeters and that forms splines 44 and head portion 46 to which actuator portions 22, 24 are coupled; and grip portions 48, 50 that are seated against the inner surfaces of shell portions 54, 56. Each grip portion 48, 50 is of 50 Shore A durometer styrene butadiene rubber (Kraton) and has a body 52 of 120° angular extent and a thickness of about 1.5 millimeter with integral ribs 30 that project about 1.2 millimeter above the outer surface of body 52. The outer surfaces of bodies 52 are seated against the inner surfaces of shells 54, 56, each of 0.5 millimeter thickness stainless steel with ribs 30 disposed in shell apertures and projecting about 0.7 millimeter above outer shell surfaces 32.

In use, the user grasps the handle portion 16 with the soft rib projections 30 contacting the fingers of the user to provide comfortable and stable ("user-friendly") handling of the razor. During shaving, the blade assembly 10 pivots as a whole on handle 16, following the contours of the skin surface being shaved. The handle portion may be a component of either a disposable razor or a cartridge razor.

While a particular embodiment of the invention has been shown and described, various modifications will apparent to those skilled in the art and therefore, it is not intended that the invention be limited to the disclosed embodiments, or to details thereof, and departures may be made therefrom within the spirit and scope of the invention.

What is claimed is:

1. A composite razor handle of the wet shave type comprising housing structure with an array of spaced apertures extending between inner and outer faces of said housing structure, and compressible resilient insert structure having a durometer value of about 50 Shore A and having a body portion and an array of projection portions integral with said body portion, the outer face of said body portion being seated against the inner face of said housing structure and said projection portions extending through said apertures in said housing structure to provide an array of soft resilient spaced portions that project above the outer face of said housing structure, the composite handle providing comfortable secure gripping structure for the razor user.

2. The razor handle of claim 1 wherein said housing structure is of metal and of elongated cylindrical configuration, and said insert structure is of elastomeric material.

3. The razor handle of claim 1 wherein each said projection portion is of elongated rib configuration and extends an angular length of at least 90°, each said rib having a width of at least about two millimeters and a length of at least about six millimeters and projecting at least about 0.5 millimeter beyond said outer face of said housing structure.

4. The razor handle of claim 3 wherein said housing structure is of metal and includes a grip portion of elongated cylindrical configuration of about one centimeter diameter and said ribs are disposed transversely to the longitudinal axis of said grip portion and are arranged in a series of about three ribs per centimeter length of said grip portion.

5. The razor handle of claim 4 wherein said ribs are spaced at least one millimeter apart and less than the width of said ribs.

6. The razor handle of claim 1 wherein said housing structure includes a grip portion of elongated cylindrical configuration of about one centimeter diameter and said projection portions are distributed along the longitudinal length of said grip portion.

7. The razor handle of claim 6 wherein said projecting portions are spaced at least one millimeter apart and less than the width of said projection portions.

8. The razor handle of claim 7 wherein each said projection portion is of elongated rib configuration, each said rib having a width of at least about two millimeters and a length of at least about six millimeters and projecting at least about 0.5 millimeter beyond said outer face of said housing structure.

9. The razor handle of claim 8 wherein said housing structure is of metal, and said insert structure is of rubber.

10. The razor handle of claim 9 wherein said ribs are arranged in a series of about three ribs per centimeter.

* * * * *